United States Patent [19]

Senoo

[11] Patent Number: 4,638,989

[45] Date of Patent: Jan. 27, 1987

[54] DEVICE TO PREVENT TRANSPORT OF POORLY ALIGNED COPY PAPER

[75] Inventor: Yoji Senoo, Yamatokoriyama, Japan

[73] Assignee: Sharp Kabushiki Kaisha, Osaka, Japan

[21] Appl. No.: 771,012

[22] Filed: Aug. 30, 1985

[30] Foreign Application Priority Data

Sep. 3, 1984 [JP] Japan ..... 59-134088[U]

[51] Int. Cl.[4] ..... B65H 7/08

[52] U.S. Cl. ..... 271/227; 271/235; 271/261

[58] Field of Search ..... 271/227, 228, 265, 261, 271/235

[56] References Cited

U.S. PATENT DOCUMENTS

T102,003 7/1982 Bullock ..... 271/227
1,908,845 5/1933 Hopkins ..... 271/227
2,428,769 10/1947 Bobst ..... 271/227
3,065,961 11/1962 Campbell ..... 271/261
3,356,364 12/1967 Grigereit ..... 271/227
3,948,170 4/1976 Ericsson ..... 271/261 X

FOREIGN PATENT DOCUMENTS 2127384 4/1984 United Kingdom ..... 271/227

*Primary Examiner*—Richard A. Schacher
*Attorney, Agent, or Firm*—Birch, Stewart, Kolasch & Birch

[57] ABSTRACT

Disclosed herein is a useful device for preventing incorrect transport of copy papers including a paper-detect member which is located in the copy-paper transport path activated by copy paper and a control member, located in advance of the copy-paper transport path and of the paper detect member, which is activated by copy papers to control the pivot motion of paper-detect member.

4 Claims, 2 Drawing Figures

DEVICE TO PREVENT TRANSPORT OF POORLY ALIGNED COPY PAPER

BACKGROUND OF THE INVENTION

The present invention relates to a misalignment prevention device in a copy-paper transport, and more particularly, to a device that prevents transport of copy paper whenever a condition exists in the transport operation that may jam the copy paper.

Conventional electrophotographic copying machines transport copy paper to the image generator, which forms pictures on the paper before ejecting it from the copying machine. Copy paper is transported to the image generator through the copy-paper transport path by means of conveyer rollers. Conventional copiers provide methods of detection, such as microswitches, which sense the position and condition of paper in the paper-transport path. In response to the information gathered from microswitches, the drive train of the conveyer rollers is modified so that copy papers can be securely and correctly transported to the image generator. In most copy machines, each copy paper should pass through a monitoring device within a specified period of time, but if the designated copy paper doesn't pass through the monitor within a predetermined time, the device records that the copy paper has been fed incorrectly and jamming has occurred along the transport path. In that situation all the operations of the conveyer roller and copying machine are suspended until the jam has been rectified. Some conventional copying machines or printers are designed to transport copy papers by examining only one edge of the paper to ensure proper alignment. Unless copy papers are correctly transported with their edge precisely aligned with a reference edge monitor however, copy papers may jam in transit or pictures and characters may be incorrectly copied or printed. To prevent this, conventional copying machines and printers employ a paper detection device at the reference edge of the paper-transport path to sense whether copy papers are being correctly transported. Nevertheless, conventional copying machines and printers are designed to identify whether copy papers have been correctly transported only after copy papers have actually passed through the paper-position monitors. Because of this, conventional copy machines and printers cannot effectively prevent the incorrectly aligned papers from being carried beyond the paper-position monitors and into conveyer rollers. This disadvantage is also present in copiers which utilize monitors in the center of the copy path to detect alignment.

SUMMARY OF THE INVENTION

In the light of the disadvantages present in conventional copying machines and printers, a present invention aims at providing the means for effectively preventing transport of copy papers whenever a condition that may cause jamming is present in the paper-transport operation. No paper can be carried forward during the copying operation when alignment of the paper is improper. Another object of the present invention is to prevent incorrect transport of copy papers from occurring by applying a new method of alignment monitoring.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from the detailed description.

In brief, the present invention provides a device for preventing an incorrect transport of copy papers. This invention includes a detection device used for monitoring the actual position of paper entering a copier. The detection device is located along the paper transport path and activated by copy paper as it traverses the path. The device also includes a control member located in advance of the paper-transport path and the above detection device which is activated by copy paper to control the pivot motion of the detection device.

BRIEF DESCRIPTION OF THE DRAWINGS

The present invention will be better understood from the detailed description given hereinbelow and the accompanying drawings which are given by way of illustration only, and thus are not limitative of the present invention in which.

DETAILED DESCRIPTION OF THE PREFERRED EMBODIMENTS

Referring now to the accompanying drawings, the preferred embodiments of the present invention are described below.

Figure 1:
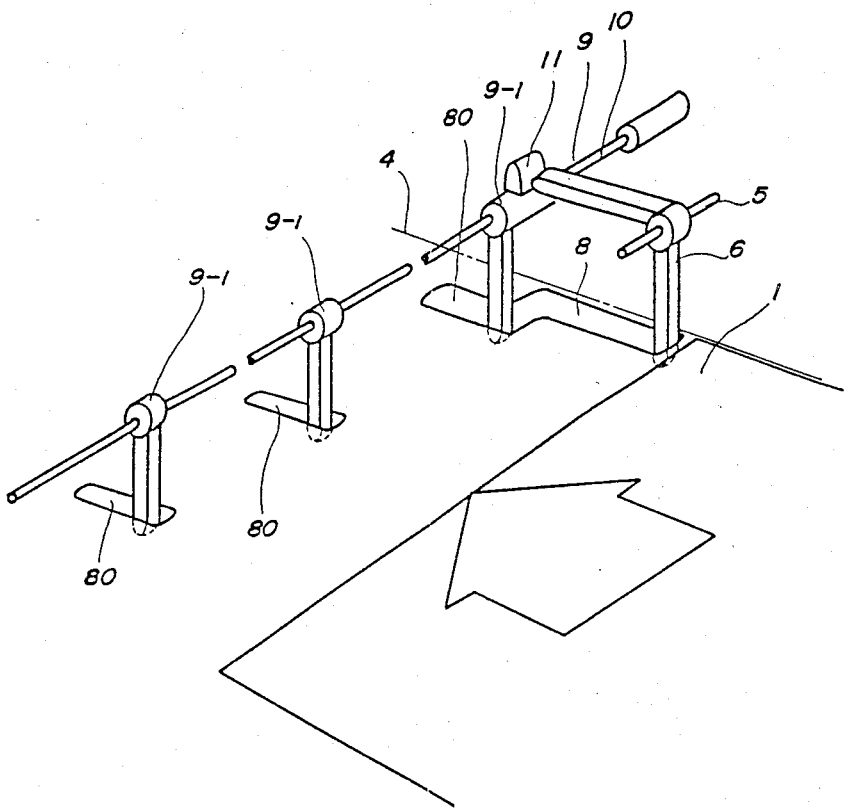
FIG. 1 is a perspective view of the copy-paper incorrect transport prevention device detailing the preferred embodiment of the present invention.
Figure 2:
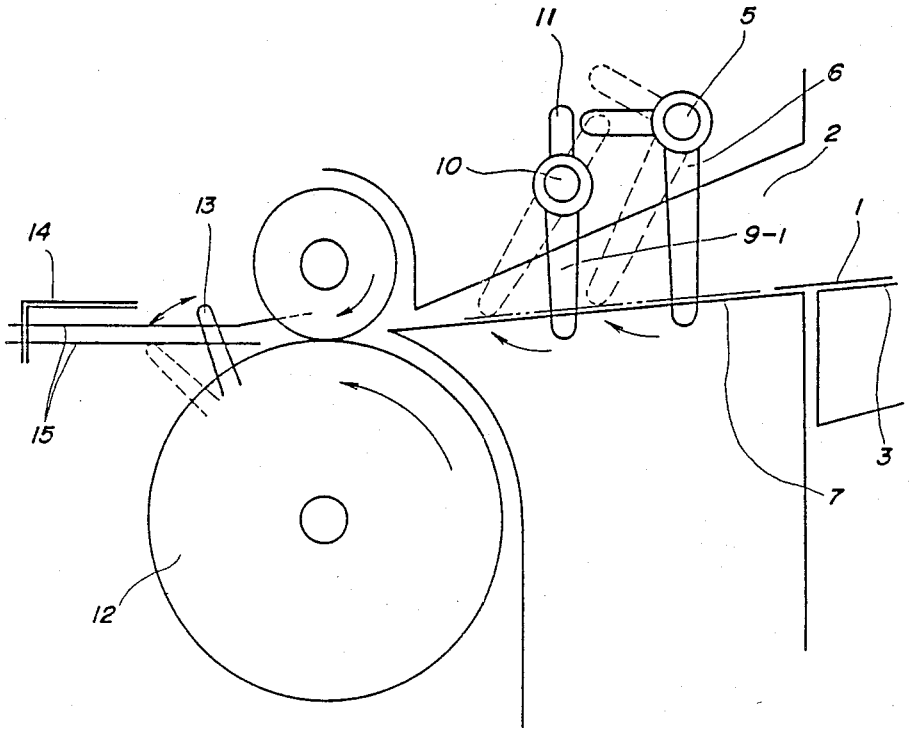
FIG. 2 is a sectional view of the same copy-paper incorrect transport prevention device.

FIG. 1 is a simplified perspective view of the copy-paper incorrect transport prevention device embodied by the present invention. FIG. 2 is the sectional view of the same copy-paper incorrect transport prevention device.

Copy paper 1 is first inserted into paper feed 3 from paper inlet 2 of the copying machine shown in the drawings. Copy paper 1 is inserted with its edge aligned with reference edge 4 of the present device. Paper inlet 2 is provided with a pivotal "L-shaped" stopper 6 to prevent copy papers from being incorrectly inserted into inlet 2. The bottom end of stopper 6 is designed to rest in an elongated hole 8 located along paper-positioning reference edge 4 of guide plate 7 that forms the copy-paper transport path. Thus, when copy paper 1 is inserted in alignment with the reference edge 4, stopper 6 starts to move.

Actuator 9, which detects the presence of copy papers in response to the movement of stopper 6, is located behind paper inlet 2. Actuator 9 includes a number of actuator pieces 9-1 along its length which are secured in the direction of shaft a 10, which rotates freely.

Connections are located at a first end of shaft 10 so that microswitches can be turned ON and OFF. The tips of actuator piece 9-1 are designed to be inserted through corresponding elongated holes 80 along guide plate 7. Accordingly, when a copy paper 1 is inserted into paper inlet 2 and has moved past L-shaped stopper 6, an actuator piece 9-1 is activated and shaft 10 starts to rotate. These operations turn ON microswitches signifying the presence of paper in the transport path. When paper is detected, a paper feed roller 12 starts to rotate. Connector piece 11 of actuator 9-1 comes in contact with the interior portion of stopper 6 (on reference edge 4.) In its resting state connector piece 11 remains engaged with the interior end of stopper 6, thus preventing any movement of actuator piece 9-1. When stopper 6 starts to move, the obstruction of connector piece 11 is removed, releasing the exterior end of stopper 6, and allowing actuator piece 9-1 to move in response to the insertion of a copy paper 1.

Paper-feed roller 12 is located in a position opposite guide plate 7. Paper feed roller 12 moves the properly-fed paper along its surface with the aid of subordinate roller which is powered only by qravitational contact with paper feed roller 12. Detection device lever 13 monitors the transport of copy paper from its location immediately behind paper-feed roller 12 in the copy-paper transport path. Copying operations begin as soon as operation lever 13 is rotated.

Reference number 14 in drawing 2 indicates the stopper plate which both regulates the entrance of copy paper into the upper and lower guide plates 15, (forming the copy-paper transport path) and briefly blocks the progress of the paper. Stopper plate 14 prevents copy paper 1 from being transported until its progress will be synchronous with the proper rotation of the photoreceptor. Stopper plate 14 is removed from the paper-transport path upon reception of synchronized signals from the photoreceptors, and the copy paper may then proceed. The removal of stopper plate 14, reactivates paper-feeding roller 12 so that a copy paper 1 can be transported.

Using the copy-paper transport device featured above, when manually inserting copy paper 1 through inlet 2 via the copy-paper feeder 3, the following operations occur. When the edge of the copy paper is inserted in alignment with reference edge 4, stopper 6 frees the connection between actuator piece 9-1 and connector piece 11, as shown in FIG. 2. The inserted copy paper is carried farther forward, activating actuator piece 9-1. Microswitches activated by the rotation of shaft 10 detect that the copy paper has been inserted, which in turn causes the rotation of paper-feed roller 12. When paper-feed roller 12 starts to rotate, the inserted copy paper 1 is held between rollers and then carried forward. The rotation of paper-feeder roller 12 causes operation lever 13 immediately behind paper-feed roller 12 to rotate, thus activating the copying operation. When the front of copy paper 1 comes in contact with stopper plate 14, the copy paper stops. At this point, paper feed roller 12 continues to rotate while the subordinate roller stops turning. When this condition is present and stopper plate 14 is released from the paper-transport path by a signal generated by the rotation of the photoreceptor, the paper transport resumes and copy paper 1 is sent to the image generator, which prints a normal image.

Conversely, when copy paper 1 has been inserted into the paper inlet 2 without correctly being aligned with reference edge 4, the inserted paper will not actuate stopper 6. Because this stopper 6 constrains the movement of the actuator 9 the tip end of the inserted copy paper 1 will be withheld from the paper feed roller 12 by the actuator piece 9-1, so that any further movement of this paper is blocked. This design as described, securely and effectively prevents copy papers from being incorrectly transported through the copy paper path.

The preferred embodiment of the present invention has been described above in reference to the manual paper feeding mode. The spirit and scope of the present invention is not limited to the above-cited preferred embodiment however, and it may also be applied to automatic paper feeders. Moreover, the above design embodied by the present invention may also utilize alignment detection devices located in the center of the copy-paper transport path as well. In summary, conveyance of copy papers under faulty alignment at the reference edge can be effectively prevented from transport in advance of paper conveying means such as rollers or belts.

Furthermore, if stopper 6 is activated, copy papers are securely prevented from incorrectly being transported not only when the copy paper is correctly aligned using an edge monitor, but also when the copy paper is aligned with the center reference line. Stopper 6 may also be placed at the center reference line.

As described above, the preferred embodiment of the present invention related to the copy-paper incorrect transported prevention device effectively controls the movement of the paper-detect member using a stopper provided at the reference position best suited for correctly conveying copy papers, and therefore, it is possible to securely control the movement of the paper-detect member and prevent copy papers from incorrectly being transported. The device also prevents copy paper from jamming in the transport path. As being described, this simplified combination in mechanism is a great improvement in this preferred embodiment.

The above preferred embodiment has been described in reference to an electrophotographic copying machine. It is very clear however, that the preferred embodiment can also be applied to devices other than electro-photographic copying machines.

While only certain embodiments of the present invention have been described, it will be apparent to those skilled in the art that various changes and modifications may be made therein without departing from the spirit and scope of the present invention as claimed.

What is claimed is:

1. A device for ensuring correct transport of sheet material along a sheet material path comprising:

guide plate means, provided adjacent said sheet material transport path, for supporting said sheet material during transport, said guide plate means having an elongated reference edge parallel to said transport path and along one edge thereof, said elongated reference edge guiding an edge of said sheet material therealong during correct transport;

inlet feed means for feeding said sheet material to said transport path adjacent said guide plate means;

a plurality of actuator arms positioned transverse to said transport path, said actuator arms, when in a material restricting position inhibiting movement of said sheet material along said paper path, said actuator arms being collectively movable from said transport path in response to the pressure of said sheet material contacting at least a majority of said actuator arms and therefore being aligned with respect to said transport path; and stopper means, positioned along said transport path upstream from said actuator arms and adjacent said elongated reference edge, for determining the presence of said sheet material adjacent said elongated reference edge, said stopper means inhibiting the movement of said actuator arms from said material restricting position until the presence of said sheet material is detected, thereby enabling movement of said actuator arms.

2. A device according to claim 1, wherein said plurality of actuator arms restrain said sheet material due to a lack of frictional force necessary to rotate said actuator arms until said sheet material squarely abuts all of said arms.

3. A device according to claim 1, wherein said device is included within an electrophotographic copying machine having a photographic drum.

4. A device according to claim 3, wherein movement of said plurality of actuator arms initiates a copying operation in said copying machine.

* * * * *